US007962984B2

(12) United States Patent
Popp

(10) Patent No.: US 7,962,984 B2
(45) Date of Patent: Jun. 21, 2011

(54) TUBULAR PILLOWS HAVING ATTACHABLE AND DETACHABLE ENDS AND RELATED METHODS

(76) Inventor: Phreddie D. Popp, Pittsboro, NC (US)

( * ) Notice: Subject to any disclaimer, the term of this patent is extended or adjusted under 35 U.S.C. 154(b) by 0 days.

(21) Appl. No.: 12/543,732

(22) Filed: Aug. 19, 2009

(65) Prior Publication Data

US 2010/0043147 A1 Feb. 25, 2010

Related U.S. Application Data

(60) Provisional application No. 61/189,649, filed on Aug. 21, 2008.

(51) Int. Cl.
*A47G 9/10* (2006.01)

(52) U.S. Cl. ..... 5/640; 5/657; 5/490; 5/491

(58) Field of Classification Search ..... 5/636, 639, 5/640, 652, 657, 490, 491
See application file for complete search history.

(56) References Cited

U.S. PATENT DOCUMENTS

| | | | | |
|---|---|---|---|---|
| 2,877,472 | A | 3/1959 | Wagner | |
| 3,848,281 | A | 11/1974 | Mathews | |
| 4,393,520 | A | 7/1983 | Koch | |
| 4,651,349 | A | 3/1987 | Heiler | |
| 4,951,317 | A | 8/1990 | Gray et al. | |
| 5,159,727 | A | 11/1992 | McCracken | |
| 5,239,717 | A | 8/1993 | Sue | |
| 5,440,769 | A | 8/1995 | Thomas | |
| 5,707,031 | A | 1/1998 | Creighton-Young | |
| 6,041,458 | A | 3/2000 | Vickers et al. | |
| 6,272,703 | B1 | 8/2001 | Swezey et al. | |
| 6,381,786 | B1 | 5/2002 | Cadden | |
| 6,438,779 | B1 | 8/2002 | Brown | |
| D475,880 | S | 6/2003 | Albright | |
| 6,578,218 | B2 | 6/2003 | Wassilefsky | |
| D503,579 | S | 4/2005 | Covert | |
| 7,131,156 | B1 | 11/2006 | Walker-Craft | |
| 7,261,374 | B2 | 8/2007 | Potosky | |
| D590,648 | S | 4/2009 | Rahimian | |
| 2006/0200910 | A1 * | 9/2006 | Taylor | 5/652 |

* cited by examiner

*Primary Examiner* — Michael Trettel

(57) ABSTRACT

Variable-use tubular pillows having attachable and detachable ends and related methods are disclosed. According to an aspect, a tubular pillow in accordance with the subject matter disclosed herein may include a pillow body having first and second ends being opposed to one another and being attachable to and detachable from one another. The pillow body forms a tube shape having a central tunnel when the first and second ends are attached. Further, the tubular pillow may include a removable cover for covering the pillow body.

20 Claims, 5 Drawing Sheets

TUBULAR PILLOWS HAVING ATTACHABLE AND DETACHABLE ENDS AND RELATED METHODS

CROSS REFERENCE TO RELATED APPLICATION

This application claims the benefit of U.S. provisional patent application No. 61/189,649, filed Aug. 21, 2008, the content of which is incorporated herein in its entirety.

TECHNICAL FIELD

The subject matter disclosed herein relates to pillows. Particularly, the subject matter disclosed herein relates to variable-use tubular pillows having attachable and detachable ends and related methods.

BACKGROUND

Typically, a pillow is a fabric bag ticking stuffed with a suitable soft resilient material, such as fiberfill, down or foam. Generally, pillows are used for providing a soft cushion on which to place one's head while resting or sleeping, either in bed, which generally have a removable cover; or on furniture in which case the pillows typically have a permanent fabric cover. Pillows have also been used in variety of other specific ways. For example, a caretaker of an infant or small child may utilize a pillow to cushion child's head while he or she is held against the caretaker's arm. In another example, a person may place a pillow under his or her injured arm or leg for elevating the extremity for increased comfort. Pillows have been especially useful in this manner following trauma or surgery. In yet another example, nursing home patients with bedsores from constant pressure at the elbow, knee, or such regions may use a standard pillow to try to relieve discomfort on the affected area. Pillows may also be used as a comfort support for arthritic extremities.

The use of a standard pillow for the aforementioned reasons and other purposes has some limitations and disadvantages. For example, the standard pillow can shift during normal body movement, especially during sleep. In addition, for example, the standard pillow does not provide for a combined comfort for both a caregiver and infant or small child during feeding or cuddling.

To address the aforementioned limitations and disadvantages, some modifications have been made to pillows to enhance their utility for specific functions. Particularly, there are a number of pillows configured to provide and means for encircling a person's arm or leg. One disadvantage of some known pillows, among others, is the lack of continuous cushioning around the entirety of the user's arm. Another disadvantage of other pillows is the entire pillow must be laundered in a tubular configuration, which can require an extended time period for drying. Still other disadvantages are the cumbersome, uncomfortable techniques required to utilize some pillows, such as straps, elastic, and/or a sling around user's neck. Therefore, it is desired to provide pillows in multiple environments overcoming these disadvantages, as well as providing additional improvements over prior pillow designs.

SUMMARY

Tubular pillows having attachable and detachable ends and related methods are disclosed. According to an aspect, a tubular pillow in accordance with the subject matter disclosed herein may include a pillow body having first and second ends being opposed to one another and being attachable to and detachable from one another. The pillow body forms a tube shape having a central tunnel when the first and second ends are attached. Further, the pillow body may include a removable cover for covering the pillow body.

According to another aspect, a tubular pillow before attaching the first and second ends in accordance with the subject matter disclosed herein, may have a width of about 15 inches and a length of about 26 inches, or any other suitable dimensions.

According to yet another aspect, a tubular pillow body ticking in accordance with the subject matter disclosed herein may be formed of a substantially soft and resilient material, and is subsequently filled with pliable synthetic fiber filler, down, foam, or other suitable material.

According to another aspect, the ends of the pillow body may include hook-and-loop fasteners for attachment of the ends to one another and for detachment of the ends from one another. Alternatively, buttons may be attached to one end and holes formed in the opposing end of the pillow body such that the buttons and holes can be used to attach and detach the ends. By attaching the ends together, the pillow body may form the central tunnel for fitting to the arm or leg of a person.

According to another aspect, a tubular pillow in accordance with the subject matter disclosed herein, the removable cover may be formed of a substantially rectangular-shaped fabric piece with two opposed linear edges thereof connected together defining a tunnel for receiving the pillow body inside the removable cover. Further, the removable cover may be formed of a washable material such as cotton and/or polyester fabric. The pillow body cover may be a disposable liquid-resistant material suitable for protecting all surfaces of the tubular pillow body.

Accordingly referring to yet another aspect, a method is disclosed herein for providing a tubular pillow in accordance with an embodiment. The method may include providing a pillow body as described herein. Further, the method may include covering the pillow body with an option of removable covers as described herein.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the invention is not limited to the specific methods and instrumentalities disclosed. In the drawings.

DETAILED DESCRIPTION

The subject matter of the present invention is described with specificity to meet statutory requirements. However, the description itself is not intended to limit the scope of this patent. Rather, the inventor has contemplated that the claimed subject matter might also be embodied in other ways, to include different elements similar to the ones described in this document, in conjunction with other present or future technologies.

Tubular pillows according to various embodiments disclosed herein may include fastening elements at opposing ends that connect to each other to form a central tunnel for multiple uses in various environments. An exemplary use of the tubular pillows disclosed herein includes use by a caregiver handling an infant or small child. It is also beneficial for parents, nurses, and other caregivers when caring for larger children, especially, for example, sick children who require continued comforting and holding by a caregiver for extended periods of time. Still another exemplary use would be as a protection of the elbow, knee, or ankle for persons confined to a wheelchair or bed such as, for example, arthritic patients and those recovering from injury or surgery.

In one embodiment, a tubular pillow may be 12 inches wide, with an inner central tunnel circumference of approximately 24 inches, and is approximately 15 inches long. The pillow may include two protective washable cover designs. One cover may be a fabric designer cover that covers only the exterior surface of the pillow. Another removable cover may protect both the interior and exterior surfaces from soil and body perspiration. In addition, a medically-approved disposable cover of liquid-resistant material may cover the inner tunnel as well as the exterior surface of the pillow. Alternatively, the pillow ticking may be constructed of a designer material and not require a cover for private use. In a setting such as a hospital, daycare center, or nursing home, a variable model of the pillow ticking may utilize a fabric that meets federal and state governmental guidelines for infection control as understood by those of skill in the art. For ease in laundering, the tubular pillow cover is removed and the tubular pillow is disassembled to a flattened position.

The pillow may also be useful as an arm, ankle, or knee protection for patients recovering from a trauma or surgery, such as, for example, knee replacement surgery. For example, the pillow can aid as a shield on the extremity to prevent from uncomfortable contact with: an opposing knee when sleeping on one's side during convalescing; a chair arm that does not provide a soft comfortable surface; or accidental contact with other surfaces or objects that may cause additional pain or injury, such as a side rail on a hospital or nursing home bed, leg extensions, and arm rests on a wheelchair.

Figure 1:
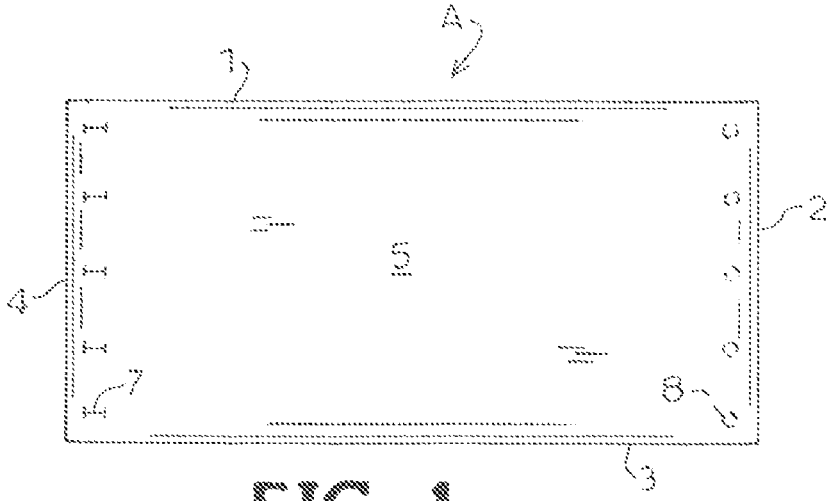
FIG. 1 is a top view of the body of a pillow body before attachment of its ends in accordance with an embodiment of the subject matter disclosed herein.

FIG. 1 illustrates a top view of a body A of a tubular pillow before attachment of its ends in accordance with an embodiment of the subject matter disclosed herein. Referring to FIG. 1, the tubular body A is shown in an "unattached mode" wherein opposing ends 2 and 4 are unattached such that the pillow is flat. When ends 2 and 4 are attached, the pillow body A forms a tube shape having a central tunnel, as shown and described in more detail herein below.

Ends 2 and 4 can be attached to one another using a hook-and-loop mechanism. Particularly, the length of end 2 can have a plurality of buttons 8 attached thereto, and the length of end 4 can define a plurality of holes 7 configured to mate with the buttons. Thereby, ends 2 and 4 can be attached to one another and can be detached from one another. In an alternative example, ends 2 and 4 may be attached by a hook and loop fastener product, such as, for example, the product known as VELCRO® brand product, which is produced by Velcro Industries B.V. of the Netherlands. The hook-and-loop pieces of the VELCRO® brand product can extend all or a portion of the lengths of the ends. As will be appreciated by those of skill in the art, any other suitable mechanism may be used for attaching and detaching the ends of the pillow body.

The pillow body A can have a size of about 15 inches×26 inches. Particularly, the pillow body A also includes opposing linear edges 1 and 3 having a length of about 26 inches. The lengths of ends 2 and 4 are each about 15 inches, although the ends' lengths may be any other suitable length. Alternatively, the linear edges and lengths of the ends may have any other suitable length or shape.

Figure 2:
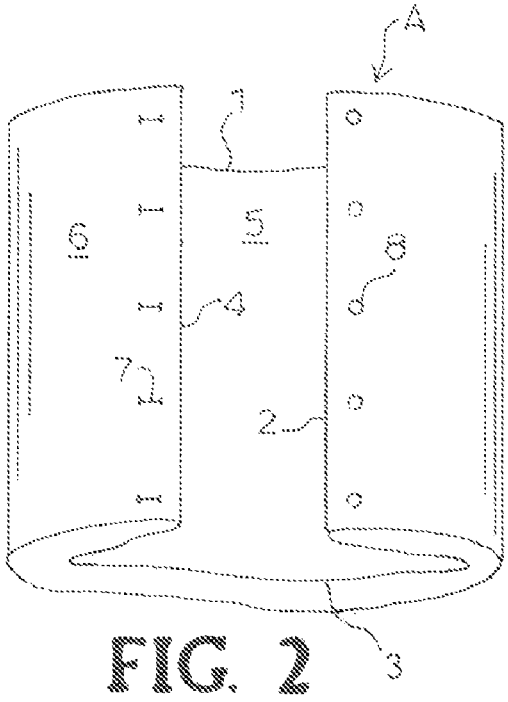
FIG. 2 is a perspective view of the pillow body shown in FIG. 1 with its ends positioned for attachment to one another.
Figure 3:
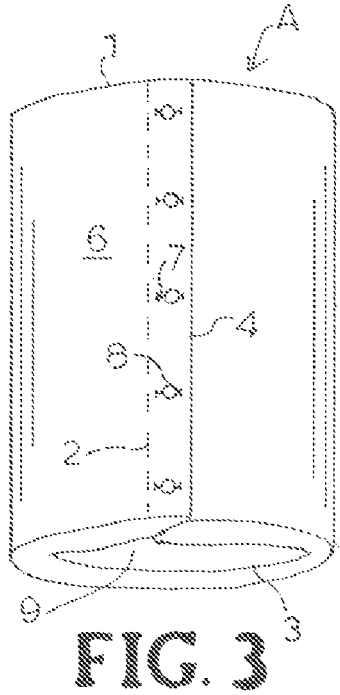
FIG. 3 is a perspective view of the tubular pillow body shown in FIGS. 1 and 2 wherein its ends are attached such that the pillow body forms a tube shape having a central tunnel, presenting as a tubular pillow body.

The pillow body A includes a substantially rectangular-shaped ticking side 5 and an opposing side ticking 6 (shown in FIGS. 2 and 3). The pillow ticking can be constructed using any suitable material such as, for example, a liquid-resistant material. For example, the pillow ticking can be made of nylon. Alternatively, for example, the ticking of the pillow body A can be made of a cotton fabric, polyester fabric, or a combination polyester/cotton fabric. In an infection control environment, for example, the pillow ticking may be a medical grade fabric such as HERCULITE® SURE-CHEK® material (produced by Herculite Products, Inc. of Emigsville, Pa.), or the like, which is liquid-resistant and has an antimicrobial protection.

The edges of the sides may be sewn together or otherwise suitably attached together for forming an interior space in which a substantially soft and resilient material is enclosed. For example, the interior space can contain hypoallergenic fiberfill, down, foam, or the like. The soft and resilient material can substantially fill the interior space of the pillow body ticking for providing suitable comfort to a user.

FIG. 2 is a perspective view of the pillow body A with ends 2 and 4 near one another for attachment to one another. FIG. 3 is a perspective view of the pillow body A, wherein ends 2 and 4 are attached such that the pillow body forms a tube shape having a central tunnel 9.

Figure 4:
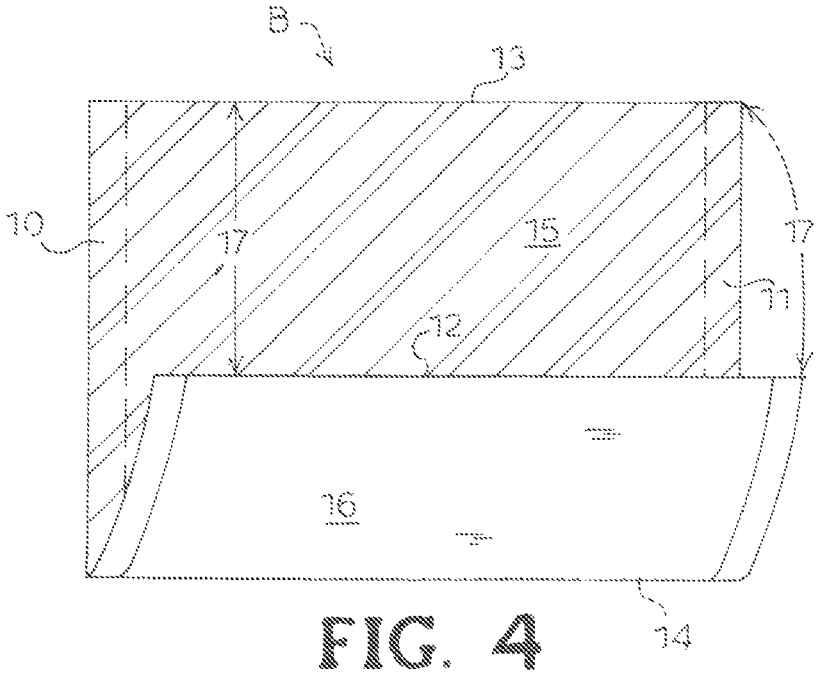
FIG. 4 is a perspective view of a removable, tubular pillow cover for covering the pillow body shown in FIGS. 1-3 according to an embodiment of the subject matter disclosed herein.
Figure 5:
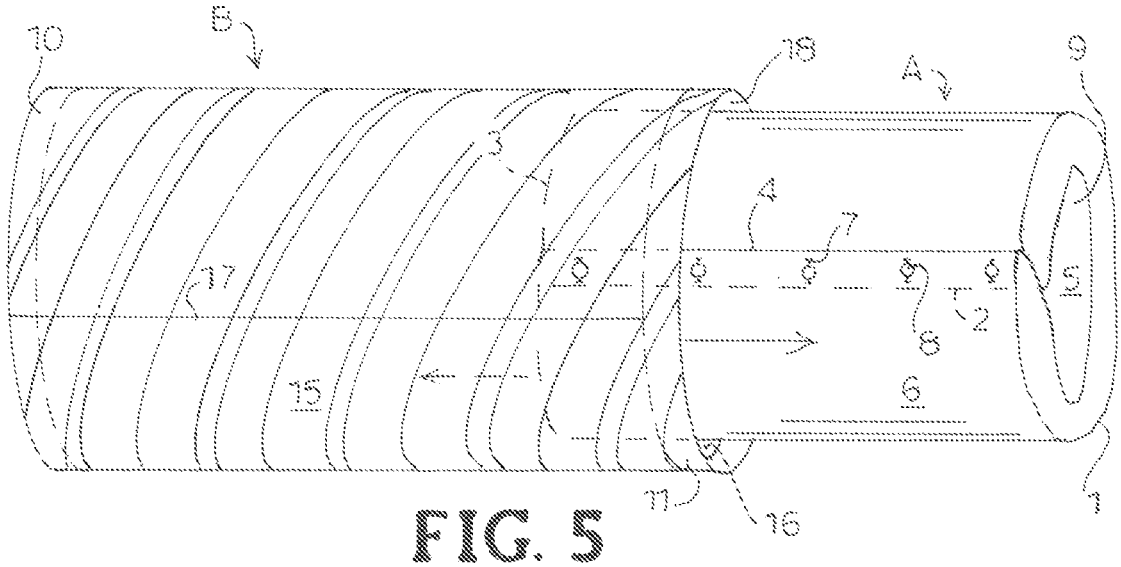
FIG. 5 is a perspective view of the cover shown in FIG. 4 being positioned over the exterior of the assembled tubular pillow body according to an embodiment of the subject matter disclosed herein.

FIG. 4 is a perspective view of a removable, tubular pillow cover B for covering the pillow body A according to an embodiment of the subject matter disclosed herein. Referring to FIG. 4, the cover B is made of a washable material, which can be made of cotton, polyester, a combination thereof, or the like fabric material. The cover B is shown at a stage in its construction. The cover B is intended to protect the pillow body A, such as the outer side 6 and/or central tunnel 9, from soil. As such, the cover B has two opposing ends 12 and 13 attached together with a hem 10 and 11, which can vary in depth, such as, for example, 1.5 or 2 inches or any suitable depth. The opposing lengths 12 and 13 are superimposed on each other by folding the rectangular fabric material of the cover B with the printed or exterior surface 15 on the inner side of the fold 14, and the back surface 16 of the material on the outside of the fold 14 as shown in FIG. 4. Once this has been accomplished, the opposing lengths 13 and 14 are then superimposed on each other and a seam sewn 17 to connect the opposing lengths 13 and 14, thus the open-ended tubular cover B becomes evident. The tubular cover embodiment B is then turned right side 15 out so the seam will be on the inside 16 of the tubular pillow cover B; thus the printed pattern 15 will be visible on the outside, as shown in FIG. 5. An alternative method would be the use of a pre-woven circular material of the appropriate circumference to cover the tubular pillow embodiment A, with a hem on each end 10 and 11 as seen in FIG. 4. An infection control disposable model of the tubular pillow cover embodiment B would not require a hem 10 and 11 on either end.

FIG. 5 is a perspective view of the cover B being positioned over the exterior of the assembled tubular pillow A. This design protects only the exterior 6 of the tubular pillow A. The tubular pillow cover B can extend approximately two inches beyond opposing ends of the assembled pillow body A as shown in FIG. 8.

Figure 6:
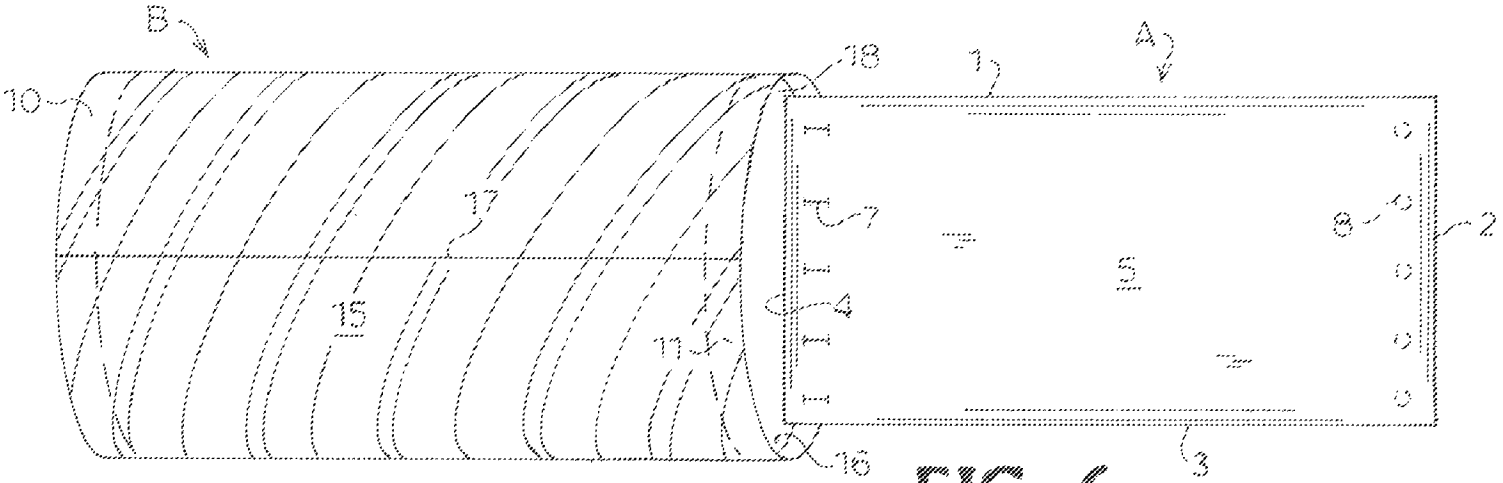
FIGS. 6 and 7 are perspective views of another embodiment of assembling a cover on a pillow body in accordance with an embodiment of the subject matter disclosed herein.
Figure 7:
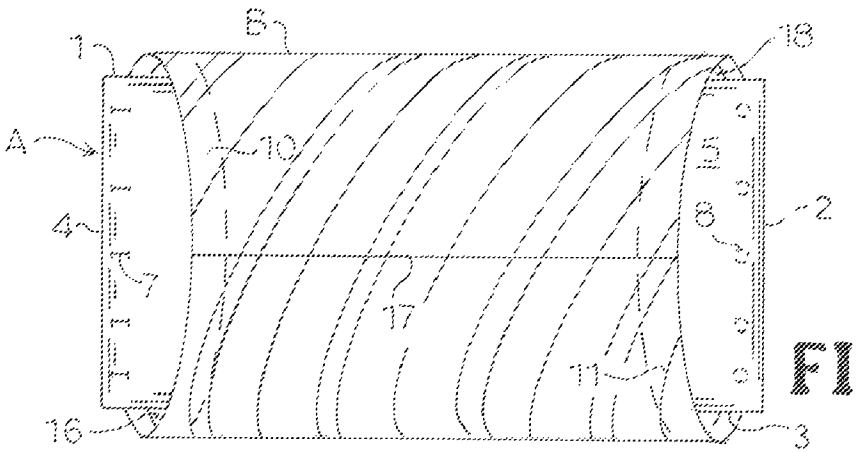

FIGS. 6 and 7 are perspective views of another embodiment of assembling the cover B and pillow body A. The assembly of this embodiment can protect the surface of the central tunnel 9, as well as the exterior surface of the pillow body A when assembled. Before the buttons 8 and the holes 7 are connected, the cover B is slipped over the pillow body A as shown in FIG. 6. The pillow body A and the cover B are then positioned as shown in FIG. 7 for allowing user access for connecting the buttons 8 and the holes 7 at opposing ends 2 and 4 similar to the technique used in FIGS. 2 and 3.

Figure 8:
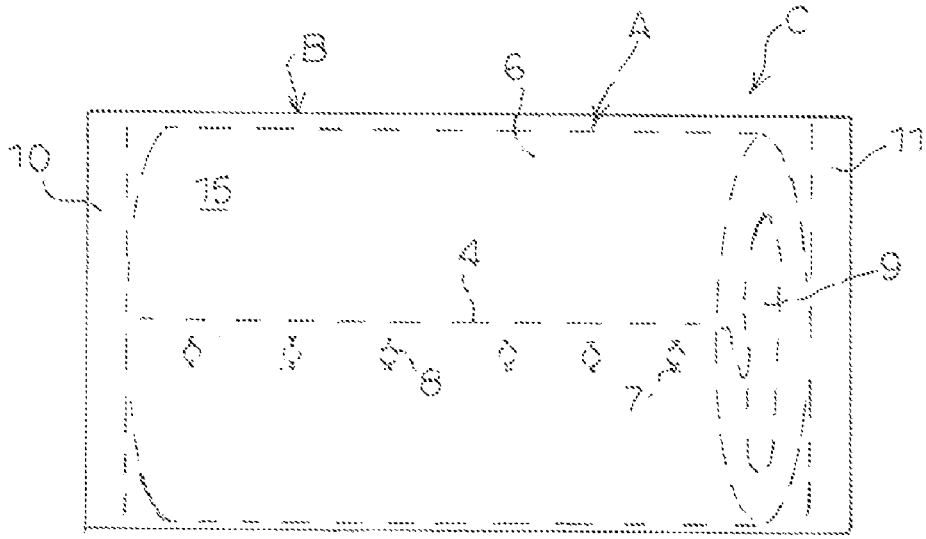
FIG. 8 is a perspective view of an assembled tubular pillow with a removable cover encasing only the exterior surface of the pillow body according to an embodiment of the subject matter disclosed herein.

FIG. 8 is a perspective view of the assembled tubular pillow C with a removable cover B encasing only the exterior surface 6 of the pillow body A according to an embodiment of the subject matter disclosed herein. The cover B can extend approximately 2 inches beyond the opposing ends of the pillow body A. The hem 10 and 11 may be omitted and substituted with a trim or edging for designer purposes.

Figure 9:
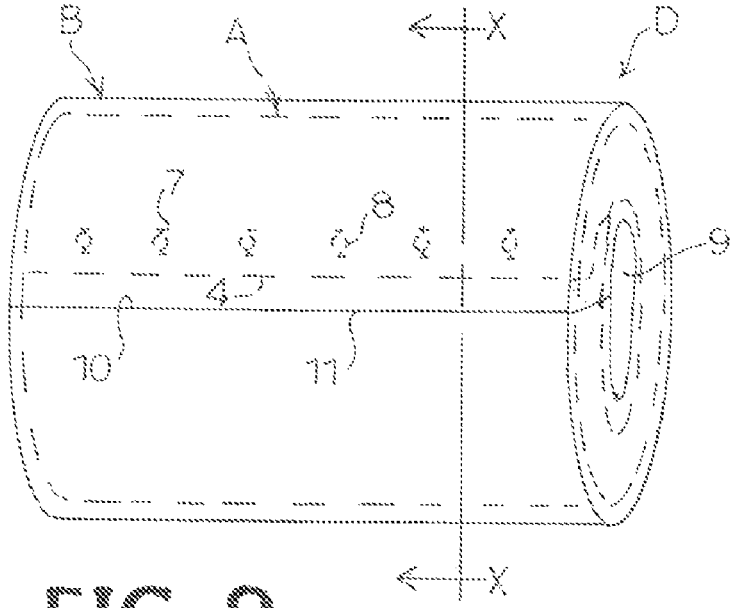
FIG. 9 is a perspective view of an assembled tubular pillow with a cover encasing the interior tubular surface and exterior surface according to another embodiment of the subject matter disclosed herein.

FIG. 9 is a perspective view of an assembled tubular pillow D according to another embodiment of the subject matter disclosed herein. The tubular pillow D has the cover B for protecting the opposing sides 5 and 6 of the pillow body A from body perspiration and soil.

Figure 10:
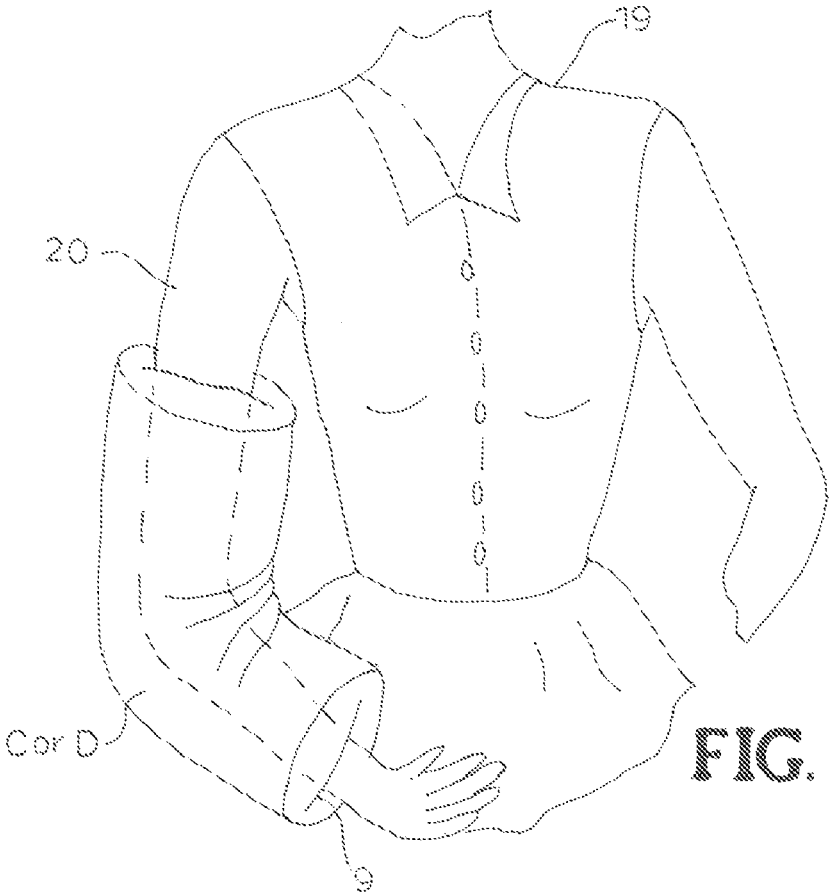
FIG. 10 is a perspective view of a user using the tubular pillow according to an embodiment of the subject matter disclosed herein.

FIG. 10 is a perspective view of a user using the tubular pillow according to an embodiment of the subject matter disclosed herein. Referring to FIG. 10, the user's arm 20 is extended through the central tunnel 9 of the tubular pillow (C or D). In an example of the use of the tubular pillow, an infant or small child can rest against the exterior of the tubular pillow.

Figure 11:
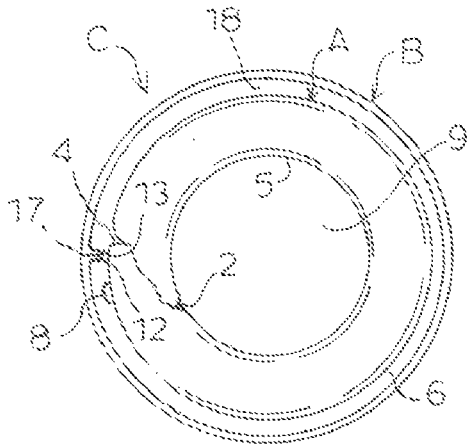
FIG. 11 is an end view of the tubular pillow shown in FIG. 8.

FIG. 11 is an end view of the tubular pillow C as shown in FIG. 8. This figure shows the cover B covering opposing sides 5 and 6 of the pillow body A.

Figure 12:
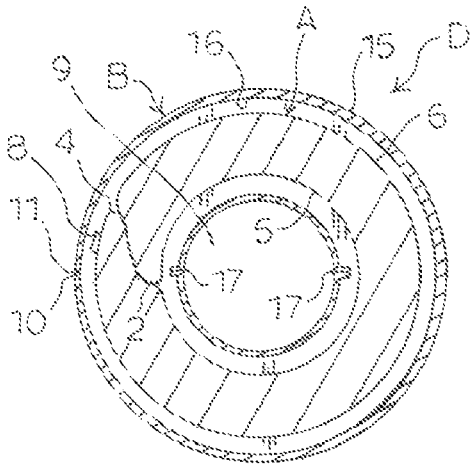
FIG. 12 is a cross-sectional end view of the tubular pillow shown in FIG. 9.

FIG. 12 is a cross-sectional end view X-X of the tubular pillow D as shown in FIG. 9. Referring to FIG. 12, the tubular pillow D is shown assembled as ready-to-use. The cover B covers both the interior channel 9 and exterior surface 6 of the pillow body A.

While the embodiments have been described in connection with the preferred embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed is:

1. A tubular pillow comprising:

a pillow body including a filler and ticking surrounding the filler, wherein the pillow body includes first and second ends being opposed to one another and being attachable to and detachable from one another, each of the first and second ends defining generally planar respective first and second end surfaces that extend between opposing surfaces of the pillow body at an angle relative thereto, wherein each of the first end surface and the second end surface are configured for cooperatively mating engagement and further wherein the first end surface and the second end surface define cooperatively engageable fasteners for attaching the first and second ends, and wherein the pillow body forms a tube shape having a central tunnel when the first and second ends are attached.

2. The tubular pillow of claim 1, wherein the pillow body and the filler of the pillow body are formed of a substantially soft and resilient material.

3. The tubular pillow of claim 1, further comprising a removable cover for covering the pillow body, the removable cover being formed of a substantially rectangular-shaped fabric piece with two opposed linear edges thereof connected together defining a tunnel for receiving the pillow body inside the removable cover.

4. The tubular pillow of claim 1, further comprising a removable cover for covering the pillow body, the removable cover being formed of a washable material.

5. The tubular pillow of claim 4, wherein the removable cover is made of one of cotton and polyester fabric.

6. The tubular pillow of claim 1, further comprising a removable cover for covering the pillow body, the removable cover being made of a disposable and liquid resistant material.

7. The tubular pillow of claim 6, wherein the ticking is liquid resistant.

8. The tubular pillow of claim 1, wherein the cooperatively engageable fasteners comprise hook-and-loop fasteners attached to the first and second end surfaces for attachment of the first and seconds ends to one another, and for detachment of the first and second ends from one another.

9. The tubular pillow of claim 1, wherein the cooperatively engageable fasteners comprise a plurality of buttons on the first end surface, wherein the second end surface defines a plurality of holes configured to mate with the buttons for attachment of the first and seconds ends to one another and for detachment of the first and second ends from one another.

10. A method of providing a tubular pillow, the method comprising:

providing a pillow body including a filler and ticking surrounding the filler, wherein the pillow body includes first and second ends being opposed to one another and being attachable to and detachable from one another, each of the first and second ends defining generally planar respective first and second end surfaces that extend between opposing surfaces of the pillow body at an angle relative thereto, wherein each of the first end surface and the second end surface are configured for cooperatively mating engagement and further wherein the first end surface and the second end surface define cooperatively engageable fasteners for attaching the first and second ends, and wherein the pillow body forms a tube shape having a central tunnel when the first and second ends are attached.

11. The method of claim 10, wherein the pillow body and the filler of the pillow body are formed of a substantially soft and resilient material.

12. The method of claim 10, further comprising providing a removable cover for covering the pillow body, the removable cover being formed of a substantially rectangular-shaped fabric piece with two opposed linear edges thereof connected together defining a tunnel for receiving the pillow body inside the removable cover.

13. The method of claim 10, further comprising providing a removable cover for covering the pillow body, the removable cover being formed of a washable material.

14. The method of claim 13, wherein the removable cover is made of one of cotton and polyester fabric.

15. The method of claim 10, further comprising providing a removable cover for covering the pillow body, the removable cover being made of a disposable and liquid resistant material.

16. The method of claim 15, wherein the ticking is liquid resistant.

17. The method of claim 10, further comprising providing hook-and-loop fasteners attached to the first and second ends for attachment of the first and seconds ends to one another, and for detachment of the first and second ends from one another.

18. The method of claim 10, further comprising providing a plurality of buttons, wherein the second end defines a plurality of holes configured to mate with the buttons for attachment of the first and seconds ends to one another, and for detachment of the first and second ends from one another.

19. A tubular pillow comprising:

a pillow body having a first major surface and an opposing second major surface; and a filler material positioned between the first major surface and the second major surface, wherein the pillow body includes a first end along a length thereof that defines a generally planar first end surface that extends between the first major surface and the second major surface at an angle relative to the first major surface, and an opposing second end along a length thereof that defines a generally planar second end surface that extends between the first major surface and the second major surface at an angle relative to the first major surface, wherein the first end surface and the second end surface define engageable fasteners for matingly engaging the first end surface and the second end surface to thereby form a tube shape having a central tunnel therein that is configured for receiving a user's limb.

20. The tubular pillow of claim 19, wherein each of the first end and second end of the first major surface are in generally circumferential alignment when the tubular pillow is in the tube shape, and wherein each of the first end and second end of the second major surface are in a generally circumferential alignment when the tubular pillow is in the tube shape.

* * * * *